US008337110B2

(12) United States Patent
Rees et al.

(10) Patent No.: US 8,337,110 B2
(45) Date of Patent: Dec. 25, 2012

(54) DISPOSABLE BLEACHING CLEANING PAD

(75) Inventors: Wayne M. Rees, Racine, WI (US); Sandra J. Demant, Franksville, WI (US); Benjamin N. Shiffler, Union Grove, WI (US); Olivia Moodycliffe, Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/163,852

(22) Filed: Jun. 20, 2011

(65) Prior Publication Data

US 2011/0247653 A1 Oct. 13, 2011

Related U.S. Application Data

(62) Division of application No. 11/650,080, filed on Jan. 5, 2007.

(51) Int. Cl.
*A47L 13/30* (2006.01)
*B05C 11/00* (2006.01)

(52) U.S. Cl. ..... 401/261; 15/104.93; 401/266

(58) Field of Classification Search ..... 401/196, 401/200, 201, 207; 15/104.93, 104.94; 510/438, 510/439

See application file for complete search history.

(56) References Cited

U.S. PATENT DOCUMENTS

| | | | | |
|---|---|---|---|---|
| 3,945,936 | A | 3/1976 | Lueas et al. | |
| 4,189,395 | A | 2/1980 | Bland | 15/104.93 |
| 4,240,760 | A | 12/1980 | Levine | 401/201 |
| 4,259,383 | A | 3/1981 | Eggensperger et al. | |
| 4,374,035 | A | 2/1983 | Bossu | |
| 4,391,723 | A | 7/1983 | Bacon et al. | |
| 4,391,724 | A | 7/1983 | Bacon et al. | |
| 4,536,314 | A | 8/1985 | Hardy et al. | |
| 4,638,907 | A | 1/1987 | Bedenk et al. | |
| 4,722,802 | A | 2/1988 | Hutchings et al. | 510/192 |
| 4,733,774 | A | 3/1988 | Ping, III et al. | |
| 4,745,021 | A | 5/1988 | Ping, III et al. | |
| 4,820,579 | A | 4/1989 | Aszman | 428/304.4 |
| 4,935,158 | A | 6/1990 | Aszman et al. | |
| 5,055,216 | A | 10/1991 | Johnson | |
| 5,090,832 | A | 2/1992 | Rivera et al. | |
| 5,108,642 | A | 4/1992 | Aszman et al. | |
| 5,202,045 | A | 4/1993 | Karpusiewicz et al. | |
| 5,213,884 | A | 5/1993 | Fellows | |

(Continued)

FOREIGN PATENT DOCUMENTS

EP 0066463 A 12/1982

(Continued)

OTHER PUBLICATIONS

International Search Report and Written Opinion dated Oct. 10, 2008, Appl. No. PCT/US2007/025980.

*Primary Examiner* — David Walczak
*Assistant Examiner* — Jennifer C Chiang

(57) ABSTRACT

Disclosed are replaceable cleaning pads capable of delivering a bleaching agent and a detersive composition to surfaces being cleaned. The pads are constructed to retain bleach separate from detersive ingredients and certain other chemicals prior to use, yet permit rapid delivery of the combined chemicals to the surface being cleaned once the pad is wetted. Most preferably a detersive mixture is melt-anchored to the pad. In one form, the pad is a two layer pad, and in another form, the pad is a three layer pad.

16 Claims, 7 Drawing Sheets

U.S. PATENT DOCUMENTS

| | | | | |
|---|---|---|---|---|
| 5,429,854 | A | 7/1995 | Currie et al. | |
| 5,507,968 | A | 4/1996 | Palaikis | 15/229.11 |
| 5,605,749 | A | 2/1997 | Pike et al. | |
| 5,755,330 | A | 5/1998 | Siragusa et al. | |
| 6,112,898 | A | 9/2000 | Siragusa et al. | |
| 6,525,014 | B1 | 2/2003 | Gorlin et al. | |
| 6,576,604 | B1 | 6/2003 | Hoshino et al. | 510/438 |
| 6,716,805 | B1 | 4/2004 | Sherry et al. | |
| 6,720,301 | B2 | 4/2004 | Gorlin et al. | |
| 6,726,386 | B1 | 4/2004 | Gruenbacher et al. | |
| 6,727,215 | B2 | 4/2004 | Roberts et al. | |
| 6,815,410 | B2 | 11/2004 | Boutique et al. | |
| 6,831,051 | B2 | 12/2004 | Sommerville-Roberts et al. | |
| 6,846,784 | B2 * | 1/2005 | Engel et al. | 510/120 |
| 6,878,679 | B2 | 4/2005 | Sommerville-Roberts et al. | |
| 6,881,713 | B2 | 4/2005 | Sommerville-Roberts et al. | |
| 6,995,125 | B2 | 2/2006 | Dasque et al. | |
| 7,020,143 | B2 | 3/2006 | Zdan | |
| 7,476,047 | B2 | 1/2009 | Brunner et al. | 401/134 |
| 2002/0077266 | A1 | 6/2002 | Gabriel et al. | |
| 2002/0119907 | A1 | 8/2002 | Baker et al. | |
| 2002/0132747 | A1 | 9/2002 | Huyhn et al. | 510/218 |
| 2003/0035824 | A1 | 2/2003 | Isele et al. | |
| 2003/0050210 | A1 | 3/2003 | Pounds et al. | |
| 2003/0069155 | A1 | 4/2003 | Mangin et al. | |
| 2003/0097725 | A1 | 5/2003 | Smith | |
| 2003/0114331 | A1 | 6/2003 | Baker et al. | |
| 2003/0119696 | A1 | 6/2003 | Ingram et al. | |
| 2003/0121530 | A1 | 7/2003 | Borgonjon et al. | 134/6 |
| 2003/0162684 | A1 | 8/2003 | Huyhn et al. | |
| 2004/0067322 | A1 | 4/2004 | Baker et al. | |
| 2004/0111817 | A1 | 6/2004 | Chen et al. | |
| 2004/0115231 | A1 | 6/2004 | Hart et al. | |
| 2004/0117935 | A1 | 6/2004 | Cavalheiro | 15/244.1 |
| 2004/0127378 | A1 | 7/2004 | Sherry et al. | |
| 2004/0147425 | A1 | 7/2004 | Castro et al. | |
| 2004/0254086 | A1 | 12/2004 | Hedges et al. | |
| 2004/0266650 | A1 | 12/2004 | Lambotte et al. | 510/438 |
| 2005/0049164 | A1 | 3/2005 | Sommerville-Roberts et al. | |
| 2005/0107282 | A1 | 5/2005 | Ford et al. | |
| 2005/0113277 | A1 | 5/2005 | Sherry et al. | |
| 2005/0124519 | A1 | 6/2005 | Sherry et al. | 510/238 |
| 2005/0133174 | A1 | 6/2005 | Gorley et al. | |
| 2006/0048319 | A1 | 3/2006 | Morgan | |
| 2006/0168748 | A1 | 8/2006 | Dotterman | |
| 2008/0145388 | A1 * | 6/2008 | Roreger et al. | 424/401 |

FOREIGN PATENT DOCUMENTS

| | | | |
|---|---|---|---|
| EP | 1860177 | A | 11/2007 |
| GB | 1143238 | A | 2/1969 |
| WO | WO 00/26329 | | 5/2000 |
| WO | 2004047606 | A | 6/2004 |

* cited by examiner

DISPOSABLE BLEACHING CLEANING PAD

CROSS-REFERENCES TO RELATED APPLICATIONS

This application is a divisional application of U.S. patent application Ser. No. 11/650,080 filed Jan. 5, 2007.

STATEMENT REGARDING FEDERALLY SPONSORED RESEARCH

Not Applicable.

BACKGROUND OF THE INVENTION

1. Field of the Invention

The present invention relates to replaceable cleaning pads which deliver a bleaching agent as well as a detersive composition to a surface being cleaned. More particularly, it relates to replaceable cleaning pads that are configured to avoid incompatible chemicals contacting each other prior to use.

2. Description of the Related Art

A variety of cleaning devices are known in which a handle links to a cleaning head. For example, floor mops typically have a handle linked to a sponge-like or rag-like cleaning head. However, such cleaning heads become dirty and/or malodorous over time, and often release undesirable liquid after use. Thus, consumers dislike storing them between uses.

There have been developed replaceable cleaning heads that are used with such handles, so as to create scrubbing devices with low cost replaceable cleaning heads. See e.g. U.S. patent application publication 2004/0117935. See also U.S. patent application publication 2006/0048319, the disclosure of which is hereby incorporated by reference as if fully set forth herein. These devices have the benefit of being able to throw away the cleaning head after each use, and being able to assemble a fresh cleaning head to the handle prior to the next use.

In some such devices the cleaning head/pad merely acts as a scrubbing facilitator, with the cleaning solution being separately applied. In other devices a portion of the pad is impregnated at the factory with a cleaning solution and enclosed in a pouch until use so that the pad remains wet until use. Such devices require relatively expensive packaging as compared to a simple sponge or simple scrubbing pad.

Moreover, using a wet impregnation system restricts which chemicals can be used for the impregnation. For example, a number of surfactants, cleaning adjuvants, dyes and fragrances cannot be stored long term in a liquid medium containing a bleaching agent without inducing significant decomposition of the bleaching agent. Another consideration, especially relevant for halogen-based bleaching agents, is the antagonistic degradation of the bleaching agent via interaction with the pad materials of construction. Also, with a wet impregnation system it is difficult to control migration of various chemical components along the pad without interfering with the ability of the pad to give up those chemicals when used.

Various patent citations teach solid mixtures composed of both detersive cleaning agents and bleaching agents, as part of a cleaning pad/implement, for example U.S. Pat. Nos. 4,935,158; 5,108,642; and references therein. However, combining detersive ingredients with solid bleaching agents can cause the premature degradation of the bleaching agent due to chemical contamination of the bleaching compound, and often restricts the types of detersive ingredients which can be employed in the intimate mixture due to chemical incompatibility. Thus, a cleaning pad which physically separates the detersive ingredients from the bleaching agent would facilitate optimal long-term bleach stability in the manufactured pad provides the formulator with the best array of available cleaning ingredients as well as providing the end-user with a cleaning product which contains essentially non-degraded cleaning ingredients.

U.S. Pat. No. 5,202,045 discloses a detergent laminate for laundering clothes in which the laminate is formed from a single flexible substrate folded into an S-shaped construction. Within one region of the folded substrate is positioned a detergent composition that includes a surfactant in the form of a paste having adhesive strength sufficient to bind the two surrounding substrate areas together. In a second region of the folded substrate separate from that occupied by the detergent composition, there is a second composition, adhesive in nature, containing a component such as a bleach, bleach precursor, enzyme and/or fabric softener. No other bonding is present between the three substrate area flaps constituting the S-shaped construction because the single flexible substrate is intended to open up in laundry wash water to release the detergent composition and the second composition.

U.S. patent application publication 2005/0107282 described a wipe in which surfactant and bleach were applied to the wipe in separate extruded stripes. However, the cost of production of this product could be significant.

More generally, U.S. patent application publication 2002/0132747 disclosed the desirability of using ethoxylated alcohols and alkyl sodium sulfates as surfactants on a wipe, U.S. patent application publication 2004/0102350 disclosed that it was known to add sodium polyacrylate to cleaning compositions containing a surfactant, and U.S. Pat. No. 6,727,215 disclosed a variety of bleaches in a pouch-based system.

Notwithstanding this variety of cleaning devices and cleaning materials, a need still exists for improved replaceable cleaning pads which deliver both bleach and surfactant.

SUMMARY OF THE INVENTION

In a general aspect, the invention provides a multi-layer surface treating pad (e.g., two layers or three layers) containing a solid detersive mixture and solid bleaching agent, wherein the solid bleaching agent and solid detersive material are physically separated/segregated.

In one aspect, the invention provides a multi-layer surface treating pad that includes a first water permeable layer having a periphery and a second layer having a periphery. The first layer and the second layer are bound to each other around the periphery of the first layer and the periphery of the second layer. A solid bleaching agent is positioned in a cavity defined between the first layer and the second layer. A detersive material is incorporated into the pad at a position where it is essentially segregated from the bleaching agent.

In another aspect, the invention provides a multi-layer surface treating pad including a first water permeable layer and a second layer attached to the first layer. A solid bleaching agent is contained in a pouch, and the pouch is positioned in a cavity defined between the first layer and the second layer. A detersive material is incorporated into the pad at a position where it is essentially segregated from the bleaching agent.

In yet another aspect, the invention provides a multi-layer surface treating pad. The pad includes a water permeable first layer including an abrasive outer surface, a water permeable second layer attached to the first layer, and a third layer attached to the second layer, such that the second layer is "sandwiched" between the first and third layers. Thus, said pad has two formed cavities, one constructed from the joined first and second layers, and another using the second and third layers. A solid bleaching agent is positioned in at least one of the two cavities, and a detersive material is incorporated into the pad at a position where it is essentially segregated from the solid bleaching agent.

In still another aspect, the invention provides a cleaning device including a handle having one part of a hook/loop type fastener system, and a multi-layer surface treating pad. The pad includes a first water permeable layer, and a second layer attached to the first layer. The second layer is suitable to serve as the engaging (second) part of the hook/loop type fastener system. The pad also includes a solid bleaching agent contained in a pouch, and the pouch is positioned in a cavity defined between the first and second layers.

In yet another aspect, the invention provides a method for cleaning a hard surface. In the method, a multi-layer, two cavity cleaning pad is wetted and wiped over the hard surface to contact the hard surface and thereby clean the hard surface. The cleaning pad includes a water permeable middle layer, a solid detersive material incorporated into the pad and positioned in the cavity nearest the surface to be cleaned, and a solid bleaching agent incorporated into the (remaining) second cavity. The cleaning pad may further include an abrasive first outer water permeable layer, forming part of the cavity which contains the detersive material. The detersive material may be attached to an inner surface of the cavity. The solid bleaching agent may be positioned within the remaining cavity defined as being formed from the middle layer and the second outer layer. In one version of the method, the second outer layer is attached to a handle, and the first outer layer of the pad is wiped over the hard surface to contact the hard surface.

Until the pad is wetted at time of use, the detersive mixture is essentially segregated away from the bleaching agent. Thus, adverse chemical interactions between the detersive mixture components and the bleaching agent are avoided prior to use. When the pad is wetted and used (e.g. held under water for a brief time, followed by wiping/scrubbing) the chemicals comprising the detersive mixture and bleaching agent will quickly dissolve and migrate to the exterior of the abrasive layer, making them available for cleaning.

These pads can be used by themselves (analogous to a Brillo™ pad), or can be readily affixed to a handle for use. If the pad layer farthest away from the surface contacting layer is made of an appropriately textured fabric, that layer will both act as a back layer and provide one-half of a hook and loop attachment system. The pad can then be quickly connected to a handle that has the other half of that attachment system. See U.S. patent application publication 2006/0048319, for a description of an example hook and loop attachment system.

These pads can be produced at low cost. Hence, it is practical after using a pad for a relatively short period (e.g. cleaning a tub surround) to throw the pad away and replace it with another pad when more cleaning is desired.

The foregoing and other advantages of the present invention will become apparent from the following description. In that description reference will be made to the accompanying drawings which form a part thereof, and in which there is shown by way of illustration various example embodiments of the invention. These embodiments do not represent the full scope of the invention. Reference should therefore be made to the claims herein for interpreting the scope of the invention.

Figure 1:
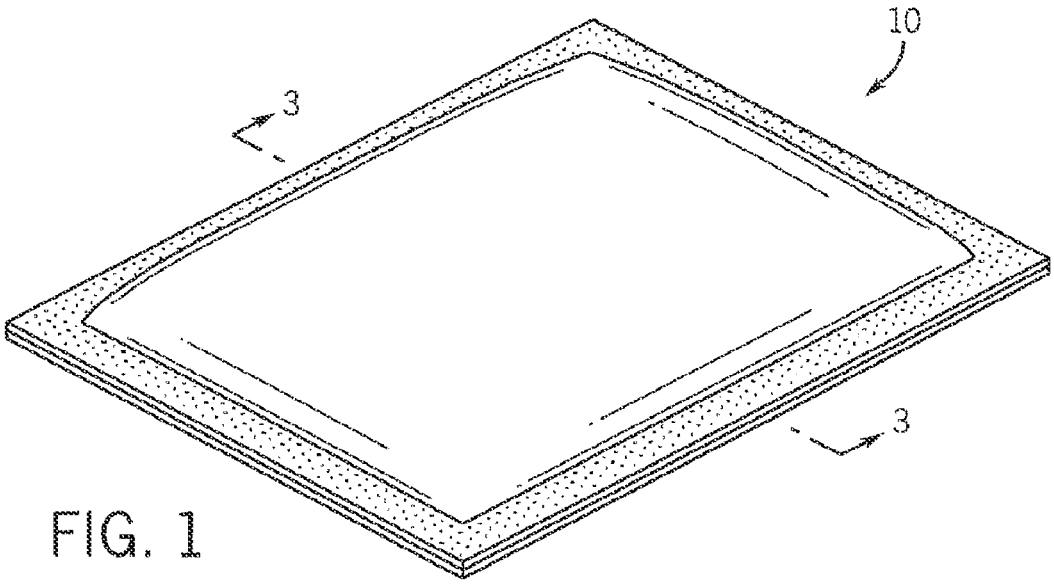
FIG. 1 is a perspective view of a two-layer surface treatment pad of the present invention.

In the drawings, the stippling represents heat sealing, the open circles represent a bleaching agent composition, the closed circles represent a detersive agent, and the closed circles within the sectioned areas represent a solid waxy surfactant.

Like reference numerals will be used to refer to like parts from Figure to Figure in the following description of the drawings.

DETAILED DESCRIPTION OF THE INVENTION

A. Overall Summary

In a general aspect, the invention provides for a two-layer or three-layer surface cleaning pad containing a solid detersive mixture and solid bleaching agent, wherein the solid bleaching agent and solid detersive material are physically separated/segregated. The term "layer" refers to a sheet of woven or non-woven fabric, textile-like material, foamed sheet, or extruded plastic sheeting, or combinations thereof. One or more layers may be of a porous nature, so as to allow the passage of water or aqueous cleaning solution. The pad may also be constructed of at least one water-impervious layer, such a continuous polyethylene sheet. The outer edges of the layers are preferably bonded or joined together by stitching, heat welding, sonic welding, adhesive or other means. Preferably, the outer edges of the layers are bonded together around at least half their periphery, and most preferably, the outer edges of the layers are bonded together around their entire periphery, the joined adjacent layers forming sealed cavities.

B. Pad Design/Configuration

While a wide variety of substrate layers are possible, non-woven synthetic (plastic) fabrics are preferred for the layers. Particularly preferred materials are various grades of polyester, polyethylene, polypropylene, polyamides, or any suitable synthetic copolymers. These materials provide good resistance to oxidative degradation by bleaching agents, and provide good layer to layer bonding, thus forming cavities with robust seals.

In one aspect, the invention provides a two-layer surface cleaning pad. It has a first water permeable layer and a second layer. The first layer and the second layer are sealed/bound/joined to each other around their peripheries. A solid bleaching agent is contained within the cavity formed by the joined first and second layers. At least one of the two layers has a porosity sufficient to allow the passage of water or an aqueous solution, but not the passage of the solid bleaching agent. A solid detersive material is incorporated onto at least one outer surface of the porous layer(s) of said pad such that it is essentially segregated from the bleaching agent. The detersive material is adhered to the outer surface of the pad in the form of an adhesive film, stripes, beads, paste, etc. The pad may be assembled to a handle for cleaning a hard surface. The pad is substantially dry before use, and the pad is typically wetted and then wiped over the hard surface to contact and thereby clean the hard surface. Preferably, the layer onto which the detersive material is attached has an abrasive outer surface intended for contacting and cleansing hard surfaces.

A second aspect of the invention provides for a two layer surface cleaning pad having the first layer and the second layer sealed/bound/joined to each other around their peripheries. A solid bleaching agent, contained within an independently formed, water permeable pouch, bag, or sachet is positioned inside the cavity formed by the sealing of the first and second layers. The pouch/bag/sachet containing the bleaching agent has a porosity sufficient to allow the passage of water or an aqueous solution, but not the passage of the solid bleaching agent or solid detersive mixture. At least one of the two pad layers has a porosity sufficient to allow the passage of water or an aqueous solution. A solid detersive material is incorporated into the cavity formed by the two layers of the pad such that it is essentially segregated from the pouched bleaching agent. The detersive material may be in the form of an adhesive film, stripes, beads, paste, powder, granule, etc. Preferably the detersive material is attached to the inside surface of at least one layer of said cavity as a water-soluble waxy solid, as to prevent contact in the dry form with the user. The pad may be assembled to a handle for cleaning a hard surface. The pad is substantially dry before use, and the pad is typically wetted and then wiped over the hard surface to contact and thereby clean the hard surface. Preferably, at least one water permeable layer of the pad has an abrasive outer surface intended for contacting and cleansing hard surfaces.

A third aspect of the invention provides for a three-layer surface cleaning pad. It has a first water permeable (outer) layer, a water permeable middle layer, and a third (outer) layer. The first, second, and third layers are sealed/bound/joined to each other around their peripheries, such that distinct and independent cavities are formed using the first and second layers, and second and third layers. A solid bleaching agent is contained inside one of the cavities, and the detersive material in the second cavity. At least one of the two outer layers has a porosity sufficient to allow the passage of water or an aqueous solution. The middle layer also has a porosity sufficient to allow the passage of water or an aqueous solution but not the passage of the solid bleaching agent or detersive material. The pad may be assembled to a handle for cleaning a hard surface. The pad is substantially dry before use, is intended to be wetted and then wiped over the hard surface to contact and thereby clean the hard surface. Preferably, at least one porous outer layer has an abrasive outer surface intended for contacting and cleansing hard surfaces.

A fourth aspect of the invention provides a three-layer surface cleaning pad. It has a first water permeable (outer) layer, a water permeable middle layer, and a third (outer) layer. The first, second, and third layers are sealed/bound/joined to each other around their peripheries, such that distinct and independent cavities are formed using the first and second layers, and second and third layers. A solid bleaching agent, contained within an independently formed, water permeable pouch, bag, or sachet is positioned inside one of the cavities, and the solid detersive material in the second cavity. The water permeable material from which the bleach pouch/bag/sachet is formed has a porosity sufficient to allow the passage of water or an aqueous solution but not the passage of the solid bleaching agent or solid detersive material. The middle layer of the pad has a porosity sufficient to allow the passage of water or an aqueous solution. The pad may be assembled to a handle for cleaning a hard surface. The pad is substantially dry before use, is intended to be wetted and then wiped over the hard surface to contact and thereby clean the hard surface. Preferably, at least one porous outer layer has an abrasive outer surface intended for contacting and cleansing hard surfaces.

In yet another aspect, the invention provides for a two layer surface cleaning pad. The pad includes a first water permeable layer, and a second layer attached to the first layer, a cavity formed by the two sealed layers, a solid bleaching agent contained in a separately formed porous, water-permeable pouch/bag/sachet, and a detersive material incorporated into the pad in a manner where it is essentially segregated from the bleaching agent. The bleach pouch is permanently positioned within the cavity by including at least a portion of the periphery of said bleach pouch/bag/sachet into the seal used to bind/join the pad layers about their peripheries thereby anchoring the pouch in a fixed location within the cavity. Alternatively, a three layer pad can be employed, with a porous middle layer "sandwiched" between the two outer layers. The middle layer of the pad has a porosity sufficient to allow the passage of water or an aqueous solution. The detersive material is incorporated into the pad in a manner where it is essentially segregated from the bleaching agent. In this case, the bleach pouch is permanently positioned in the cavity formed by the first and middle layer, or the cavity formed by the third and middle layer, by including at least a portion of the periphery of said bleach pouch/bag/sachet into the seal used to bind/join the pad layers about their peripheries thereby anchoring the pouch in a fixed location within the cavity. For both the two and three layer pads, preferably at least one porous outer layer has an abrasive outer surface intended for contacting and cleansing hard surfaces.

In still another aspect, the invention provides a hard surface cleaning device. The device includes a handle including one part of a hook/loop type fastener system, and a multi-layer surface treating pad containing a solid bleach and solid detersive mixture. The pad minimally includes: (i) an "outer" first water permeable layer which contacts the surface to be cleaned, (ii) a second "back" layer suitable to serve as an engaging part of the hook/loop type fastener system. Optionally, a third layer may be "sandwiched" between said outer and back layers.

The most preferred inventive cleaning pad has three layers, with an abrasive water permeable outer layer for hard surface cleansing, a water-permeable middle layer, and a back layer which is not water permeable and has a texture to its outer surface which forms part of a hook and loop attachment system. The cavity formed by the middle and back layer holds the bleaching agent, preferable contained within a water permeable pouch/bag/sachet, while the cavity formed by the middle and abrasive outer layer contains a waxy detersive mixture affixed to the inner (cavity) surface of the outer (abrasive) layer. While a wide variety of substrate layers are possible, non-woven synthetic (plastic) fabrics are preferred for the layers. Particularly preferred materials are various grades of polyester, polyethylene, and polypropylene, polyamides, or any suitable synthetic copolymers. These materials provide good resistance to oxidative degradation by bleaching agents, and provide good layer to layer unions, thus forming cavities and an overall pad with robust seals.

The abrasive layer which faces the surface to be cleaned may include polymeric fibers in a shape suitable for providing abrasion. The polymeric fibers in the abrasive layer are generally arranged to form an open, porous structure. The abrasive layer is capable of providing a scrubbing, rather than just polishing, wiping or drying functions. In one form, the abrasive layer has a basis weight of about 10 $g/m^2$ to about 300 $g/m^2$, preferably about 100 $g/m^2$ to about 200 $g/m^2$, and most preferably about 130 $g/m^2$ to about 170 $g/m^2$. In an example embodiment, the abrasive layer can be made of polyester/acrylic resin material such as 100% polyester fibers bonded together with an acrylic resin binder. One suitable abrasive layer is the material sold as Matador Grade RD3370-2 (Matador Converters Co. Ltd., Canada), which is 100% polyester fibers bonded together with an acrylic resin binder. The abrasiveness of the abrasive layer can be varied depending on the intended use of the product. For example, the abrasiveness can be increased by providing elevated and depressed regions in the surface of the abrasive layer. Also, the fiber materials, fiber length, fiber cross-section, fiber diameter, layer basis weight, etc. may all vary depending on the desired abrasiveness of the abrasive layer.

A preferred back layer suitable for forming a hook and loop type attachment system with a corresponding surface on a mounting handle could be made of at least partially synthetic non-woven material mounted on a synthetic extrusion film. The outer surface of the back layer is the non-woven material which functions as the loop material for the hook and loop type attachment system (such as a Velcro® assembly system) without the need for a separate loop strip. In one form, the back layer is a polyester spunlaced nonwoven material mounted on a polyethylene extrusion film (about 25 micrometers thick), such as sold by Ahlstrom Grade 26032 (Ahlstrom Windsor Locks LLC, CT, USA). The back layer may be water permeable or water impermeable depending on the expected use of the pad.

A preferred porous internal middle layer (in a three-layer structure) could be made of at least a partially synthetic nonwoven material. Preferably, the pore size should be sufficiently small as to prevent intermingling of any dry particulate bleaching agent with the detersive mixture, should this mixture be in a powder or granular/particulate form. One suitable porous internal layer is the material sold as Matador Grade FF0305, which is a 100% polyester nonwoven material. Another suitable porous internal layer is the material sold as Matador Grade RD3370-2, which is 100% polyester fibers bonded together with an acrylic resin binder.

C. Solid Detergent Mixture

It is preferable to incorporate the detersive material into said inventive cleaning pads as an essentially dry, water-soluble waxy solid, affixed to at least one of the pad layers in the form of a film, stripes, beads, "dots", or some other low-profile shape. It has been found that when said pads are wetted and used for cleaning, such water-soluble waxy solid detersive compositions provide for a highly desirable continuous and uniform controlled release of detergent materials during the cleaning process. Inclusion of the detersive material into the pad as a loose powder, granules, or pre-formed solid is also possible, but less desirable.

It is also preferable that said detersive material includes at least one water soluble non-ionic surfactant or polyethylene glycol (PEG) that is a waxy solid at room temperature, yet which melts in the temperature range about 40°-70° C. to form a flowable liquid/paste. This allows for the formulation of detersive materials which form flowable pastes at elevated temperatures, suitable for high temperature application and adhesion to at least one surface of one layer of said pad, whereupon cooling to room temperature said detergent material takes the form of a water soluble waxy solid. Said detersive materials may include other surfactants and cleaning adjuvants, such as anionic surfactants, cationic surfactants, amphoteric/zwitterionic surfactants, liquid nonionic surfactants, detergent builders, chelating agents, rinse aids, surface modifying anti-resoiling agents, inorganic or organic pH buffering agents, solid hydrotroping agents, dyes, and fragrance. Where said detersive material includes more than one chemical component, it is desirable that the components be combined and processed to form a relatively homogeneous mixture prior to incorporation into the inventive cleaning pad, preferably in the form of a water-soluble waxy solid through the process of melt-blending, followed by cooling of the mixture to room temperature. Alternatively, the detersive mixture can be pre-formed into a solid detersive block, solid ribbon, or solid strands that are proportioned and directly inserted into a cavity formed by layers of the pad. Practically, the pre-formed solid detersive block/ribbon/strands can be produced by blending the detersive ingredients to form a homogeneous mixture while it still remains in a semi-powder form. This mixture is fed into an extruder to form the solid detersive block/ribbon/strands which are further processed into smaller pre-formed solid pieces and incorporated into the cavity of said cleaning pads.

Said detersive material contains at least 5% by weight of the waxy solid water soluble non-ionic surfactant or PEG which melts in the temperature range of about 40°-70° C. to form a flowable liquid/paste. Preferably, said detersive material contains at least 15% by weight of this waxy solid water soluble non-ionic surfactant or PEG. Most preferably, said detersive material contains about 20-45% by weight of the waxy solid water soluble non-ionic surfactant or PEG. Preferred waxy solid water soluble non-ionic surfactants or polyethylene glycol polymers include:

- Ethoxylated alcohol non-ionic surfactants having an EO (ethylene oxide) to alcohol mole ratio of about 25/1 or greater, and having a melting point of at least 40° C. A representative example is Genapol® T-500 (Clariant Corporation, 50 mole ethoxylate tallow alcohol).
- Ethylene oxide—propylene oxide block co-polymer surfactants, with a HLB value of about 20 or greater and having a melting point of at least 40° C. A representative example is Pluronic® F-87 (BASF Corporation).
- Polyethylene glycol polymers having an average molecular weight of at least about 1200 and melting point of at least 40° C. A representative example is Pluracol® E1450 (BASF Corporation).

These solid waxy surfactants or polyethylene glycols have a tendency to dissolve in water somewhat slowly, thus acting as a controlled release mechanism. Melt-blending of such materials with other components of the detersive mixture also serves to control their release when wetted with water, and is highly desirable.

For good cleaning and foaming properties it is preferable that said detersive material contain one or more solid anionic surfactant. Preferred anionic surfactants include (but are not limited to): alkyl sulfates, alkane sulfonates, alkylaryl sulfonates, alpha-olefin sulfonates, and alkylated diphenyloxide sulfonates. It is preferable that said detersive material contain about 10-75% by weight of total solid anionic surfactant, and most preferably about 20-60% total anionic surfactant by weight.

Example detergent builders for use in such a detersive mixture include alkali metal carbonates (sodium/potassium salts of carbonate/bicarbonate), polyacrylate polymers, sodium/potassium citrate salts, alkali metal phosphate salts, and aminocarboxylates. Example hydrotroping agents include alkali metal salts of aromatic sulfonates (sodium xylene sulfonate, sodium toluene sulfonate and sodium cumene sulfonate). Example liquid non-ionic surfactants include ethoxylated C8-C18 alcohols with an EO to alcohol mole ratio of about 10/1 or less. Example pH buffering agents include alkali metal carbonates (sodium/potassium salts of carbonate/bicarbonate), polyacrylate polymers, sodium/potassium citrate salts, alkali metal phosphate salts, alkali metal borate salts, citric acid, malic acid, sulfamic acid, glutaric acid, succinic acid, adipic acid and alkali metal bisulfate salts. Example fillers include sodium sulfate, sodium chloride, silica, and alumina. Example rinse aids and surface modifying anti-resoiling agents include polyacrylate polymers, sulfonated polystyrene polymers, and derivatives/co-polymers thereof.

It is preferred that a processed detersive mixture be formulated which is solid at room temperature, yet flowable at temperatures greater than about 40° C. This permits the detersive mixture to be easily melted and then applied onto the surface of a pad layer. The detersive mixture will then cool and anchor/adhere to the surface of said layer. This is most efficiently done when the layer to which the detersive mixture is applied is an open-cell, porous synthetic fibered fabric such as polyethylene, polypropylene, or polyester. Thus, the detersive mixture may be solid at room temperature yet flowable at temperatures greater than about 40° C., preferably flowable at greater than about 50° C., and most preferably flowable at greater than about 60° C. This melt anchoring helps insure that the detergent will not contact the bleaching agent prior to use.

It is most preferred that the overall detersive mixture be dry, or essentially dry, to minimize mixing of the bleaching agent and detersive mixture prior to use. Hence, water contents of the detersive mixture of less than about 15% by weight are preferred, with nearly or completely anhydrous detersive mixtures being highly preferred.

An example of a preferred detersive mixture is provided in Table 1.

TABLE 1

| Ingredient | Commercial Material | Preferred Range Wt % | Preferred Formula Wt % |
|---|---|---|---|
| Solid Waxy Non-Ionic | 50 Mole Ethoxylate Tallow Alcohol, (Genapol T-500, Clariant Corporation) | 20-60 | 40 |
| Solid Anionic Surfactant 1 | Powdered Sodium Lauryl Sulfate (Stepanol Me-Dry, Stepan Corp.) | 20-50 | 35 |
| Solid Anionic Surfactant 2 | Sodium Alpha-Olefin Sulfonate (Bio-Terge AS-90, Stepan Corp.) | 0-10 | 4 |
| Hydrotroping Agent | Powdered Sodium Xylene Sulfonate (Stepanate SXS-93, Stepan Corp.) | 0-10 | 4 |
| Buffer/Builder | Powdered Sodium Polyacrylate (Goodrite K-7058D, Noveon Corp.) | 0-15 | 6 |
| Liquid Non-Ionic Surfactant | 4 Mole Ethoxylate Lauryl Alcohol (Genapol LA040, Clariant Corp.) | 0-20 | 10 |
| Fragrance | Liquid fragrance | 0-5 | 1 |

Processing of the preferred formula is accomplished by dry blending the solid ingredients, followed by addition of the liquid non-ionic and fragrance components, and heating the resulting mixture to 70° C. with agitation for a short period of time. A white fluid, viscous paste is produced, which can be easily applied (melt-anchored) to the surface of a porous substrate fabric, followed by cooling to room temperature to produce an adhered water-soluble waxy solid detersive mixture. When dissolved, the detersive mixture produces a pH of about 7.

The amount of detersive material contained in a multi-layer cleaning pad ranges from about 0.1 gram to about 20 grams. Preferably, the cleaning pad contains in the range of about 1-10 grams of detersive material, and most preferably about 2-6 grams of detersive material.

D. Solid Bleaching Agent

The solid bleaching agent of this invention may be selected from various peroxide and halogen-based bleaching compounds. Non-limiting examples of halogen-based bleaching agents include halogenated cyanuric acid and its derivative salts, halogenated hydantoins, N-chlorosuccinimide, N-chloro arylsulfonamides, N-chloroglycourils, N-chloro melamines, and calcium hypochlorite salts. Non-limiting examples of solid peroxide-based bleaching agents include alkali metal perborate salts, alkali metal percarbonate salts, salts of monopersulfate (such as DuPont Oxone®, 2 $KHSO_5.KHSO_4.K_2SO_4$), peroxyurea, hydrogen peroxide adducts of polyvinylpyrrolidone (such as ISP Peroxidone®), and solid organic percarboxylic acid compounds (such as magnesium monoperoxyphthalate and phthalimido-peroxyhexanoic acid). Anhydrous sodium dichloroisocyanurate and analogous sodium dichloroisocyanurate dihydrate compounds are especially preferred bleaching agents due to their good water solubility, effective bleaching and antimicrobial properties, and commercial availability in various powder, granular, and solid forms.

The inventive cleaning pads can contain in the range of about 0.1 gram to 10 grams of solid bleaching agent, with the preferred amount being about 0.25 grams to 2.5 grams of bleaching agent. The solid bleaching agent may be of any form (powder, granule, shaped solid, etc.) providing the material exhibits acceptable dissolution properties when the cleaning pad is wetted with water by the end-user.

The bleaching agent may be contained in a pouch/bag/sachet before incorporation into a pad according to the invention. The pouch/bag/sachet is formed from a water permeable material. A water permeable material allows water to pass into the interior of pouch and dissolve a portion of the bleaching agent and then allows a mixture of the water and dissolved bleaching agent to pass back out of the pouch. The pouch is preferably formed from a water permeable material such as a synthetic porous fabric material. Preferred fabrics include those formed from one or more polyester, polyethylene, and polypropylene fiber materials. One example pouch material is a spunlace polyester non-woven material sold as Ahlstrom Grade SX546. Suitable selection of the porosity of the pouch can be used to control release rates for the bleaching agent, and prevents transmission of the solid bleaching agent and solid detersive material through the pouch. While the outer edges of the pouch are preferably bonded together by heat-welding, the edges can be bonded together by stitching, sonic welding, adhesive or other means.

The solid bleaching agent may also be directly contained within a cavity formed by joining/sealing two layers of said cleaning pad. For any of the inventive pad configurations, said cleaning pad cavity must employ at least one porous, water-permeable layer. As such, the porosity of said layer(s) must be sufficiently small so as to prevent the transmission of the solid bleaching agent through the pad layers during product manufacturing or storage prior to end-use. The required porosity of said layer will depend on the particulate properties of said solid bleaching agent.

It should be appreciated that the pads used of the invention are preferably essentially dry during storage, albeit if desired small amounts of moisture can be present. Thus, the packaging for them need not be as expensive as a hermetically sealed pouch would be as might be typically used for a wet impregnated pad. It is preferable that the overall moisture content of the pad's chemical ingredients (detersive mixture and bleaching agent) be less than about 15% of the total chemical weight, most preferably less than 10%.

Also, until the pad is wetted at time of use, the detersive mixture is essentially segregated away from the bleaching agent. Thus, adverse chemical interactions between the detersive mixture components and the bleaching agent are avoided prior to use. When the pad is wetted and used (e.g. held under water for a brief time, followed by wiping/scrubbing) the chemicals comprising the detersive mixture and bleaching agent will quickly dissolve and migrate to the exterior of the abrasive layer, making them available for cleaning.

In a further aspect, the invention provides a method for cleaning a hard surface. In the method, any of the above inventive cleaning pads are employed. The cleaning pad is wetted with a liquid (typically water), and the pad is wiped over the hard surface to contact the hard surface and thereby clean the hard surface.

Figure 15:
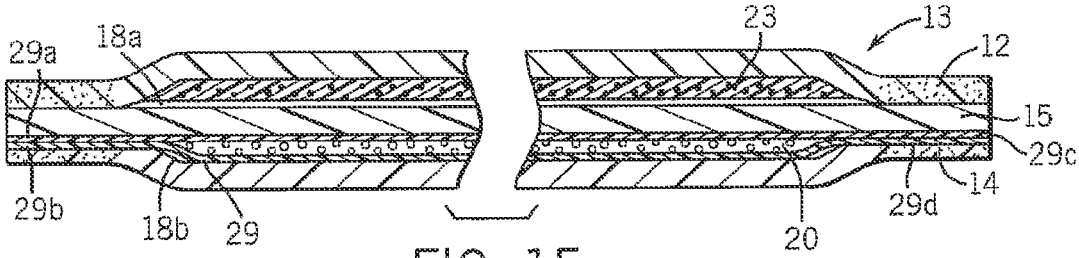
FIG. 15 is a sectional view similar to FIG. 13 showing a sixth embodiment.

A most preferred version of the inventive cleaning pad has three layers, with an abrasive water permeable outer layer for hard surface cleansing, a water-permeable middle layer, and a back layer which is not water permeable and has a texture to its outer surface which forms part of a hook and loop attachment system. The cavity formed by the middle and back layer holds the bleaching agent, contained within a water permeable pouch, while the cavity formed by the middle and abrasive outer layer contains a waxy detersive mixture affixed to the inner (cavity) surface of the outer (abrasive) layer. The following lends further description to said most preferred cleaning pad:

- The porous outer abrasive layer is a 12×9.5 cm sheet of thermally bonded polyester fiber non-woven.
- The porous middle layer is a 12×9.5 cm sheet of high loft polyester fiber non-woven.
- The back layer is a 12×9.5 cm sheet of polyester spunlaced nonwoven material mounted on a (non-porous) polyethylene extrusion film where the outer surface of the back layer is the non-woven material which functions as the loop material for the hook and loop type attachment system.
- 0.7 grams of sodium dichloroisocyanurate dihydrate bleach is contained within a sealed 12×4 cm porous pouch composed of spunlace polyester non-woven.
- 4.0 grams of preferred detersive formula from Table 1 is evenly melt-anchored as a film across a 9×6 cm rectangular area centered on the inner surface of the outer abrasive layer.
- The three layers of said pad are heat sealed/joined completely about their peripheries, also anchoring said bleach pouch within said cavity by including the ends of the longer axis of said pouch into the sealed periphery.
- FIG. 15 depicts the configuration of said constructed preferred cleaning pad.

Figure 3:
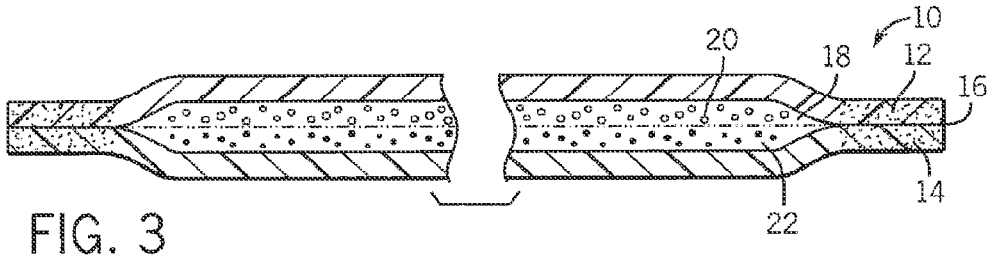
FIG. 3 is a sectional view taken along line 3-3 of FIG. 1.

Turning now to the drawings, a multi-layer surface treatment pad 10 of the present invention is shown in FIG. 1. As seen in FIG. 3, a first layer 12 is provided which is abrasive and in any event water-permeable. A second back layer 14 is attached to the first layer 12 at the peripheral edges 16. The first and second layers 12 and 14 define a cavity 18 sealed between the first and second layers 12 and 14 around the entire periphery of the first layer 12 and the second layer 14.

Figure 4:
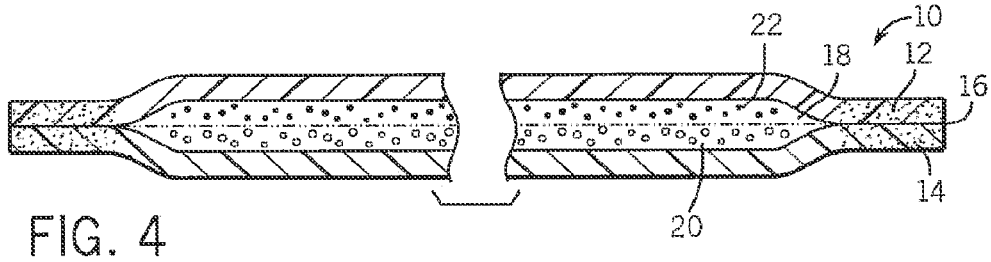
FIGS. 4 and 5 are views similar to FIG. 3, but showing the ingredients differently positioned in the cavity.

It should be recognized that in FIGS. 3-4 the solid bleaching agent 20 and detersive mixture 22 are loose within the cavity 18, and thus not segregated from one another even if initially separately layered into the pouch. However, this provides a convenient way of housing a solid bleach with a detersive waxy mixture.

Figure 5:
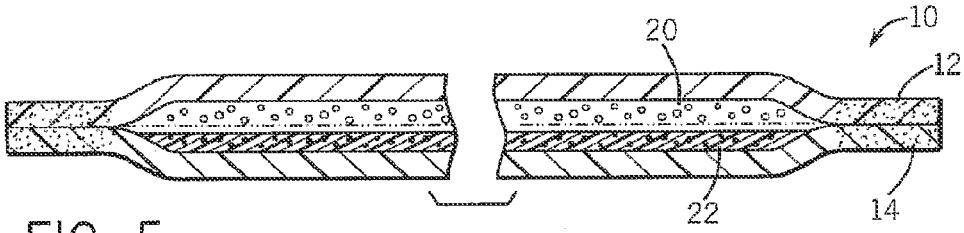

Moreover, if as shown in FIG. 5, one melt-adheres the detersive mixture 23 against the inner side of layer 14, the FIG. 5 structure is quite advantageous.

Figure 6:
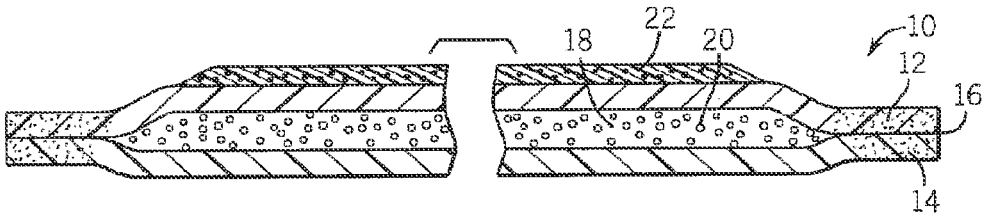
FIG. 6 shows how the FIG. 5 construction can be modified to segregate the detersive mixture in a two-layer pad.

Nevertheless, it is preferred to segregate the bleaching agent from the detersive mixture. Thus, as shown in FIG. 6, for a two-layer structure it is preferred to melt-adhere the detersive mixture 25 to the outside surface of the abrasive layer 12.

Figure 2:
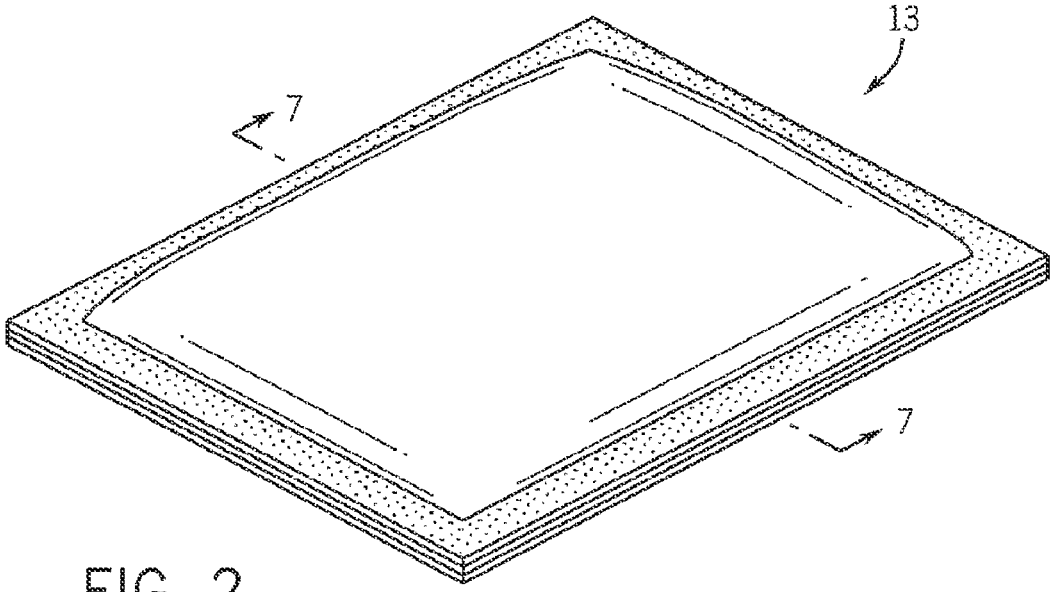
FIG. 2 is a view similar to FIG. 1, but of a second embodiment having three layers.
Figure 7:
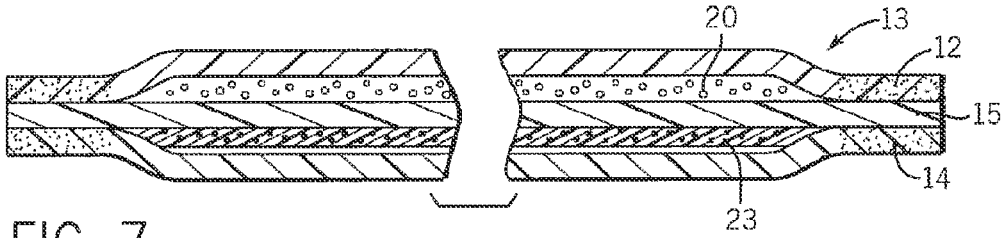
FIG. 7 is a sectional view taken along line 7-7 of the FIG. 2 second embodiment.

FIGS. 2 and 7 shows a three-layer pad 13 of the present invention, with FIGS. 8-11 showing alternative embodiments thereof which are structurally identical except for the positioning of the bleaching agent and detersive mixture. Thus, there are the same outer layers 12 and 14. Layer 12 is water-permeable and optionally (but preferably) abrasive. Third (middle) layer 15 is sandwiched between layers 12 and 14 and is water permeable. The layers 12, 14 and 15 are sealed around the entire periphery of the layers 12 and 14 and 15.

In the FIG. 7 embodiment, the solid bleaching agent 20 is loose between layers 15 and 12, while the detersive mixture 23 is between layers 15 and 14 against layer 15.

Figure 8:
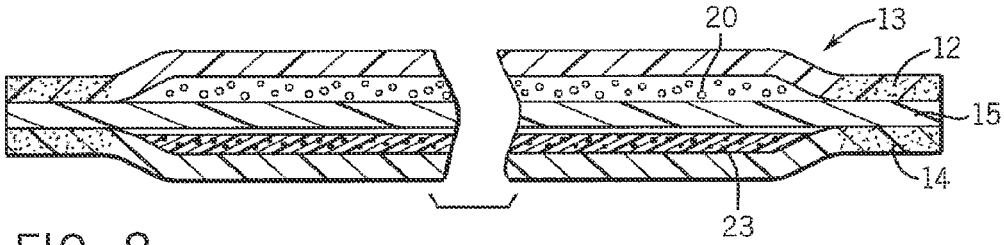
FIGS. 8-11 are views similar to FIG. 7, but showing the internal ingredients differently positioned in the same layer structure.

In the FIG. 8 embodiment, the structure is similar except that the detersive mixture is melt-adhered against layer 14.

Figure 9:
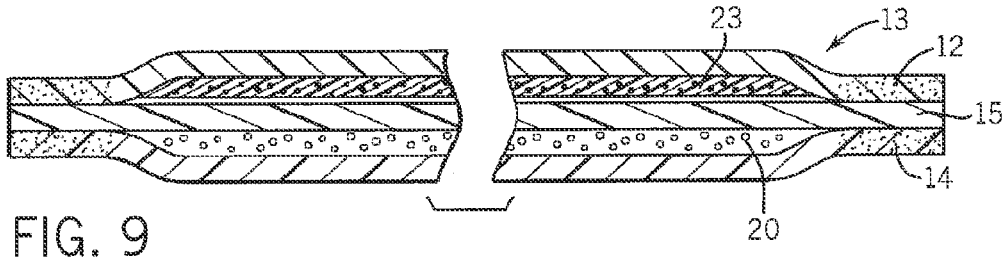
Figure 10:
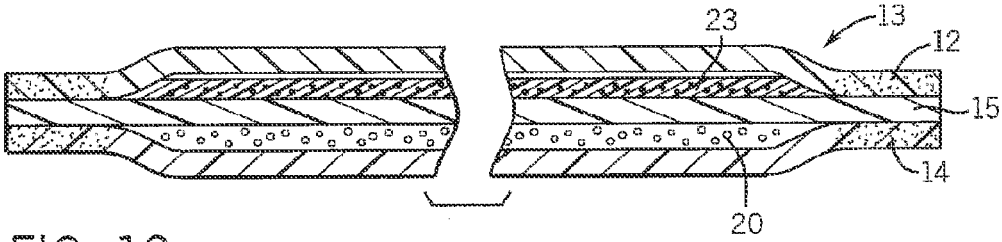

In the FIGS. 9 and 10 embodiments, the detersive mixture is between layers 12 and 15. In the FIG. 9 embodiment, it is against layer 12 and the bleach is between layers 15 and 14. FIG. 9 is a highly preferred embodiment because the back layer 14 also helps retain the bleach.

In the FIG. 10 embodiment, the detersive mixture 23 is melt-adhered against layer 15.

Figure 11:
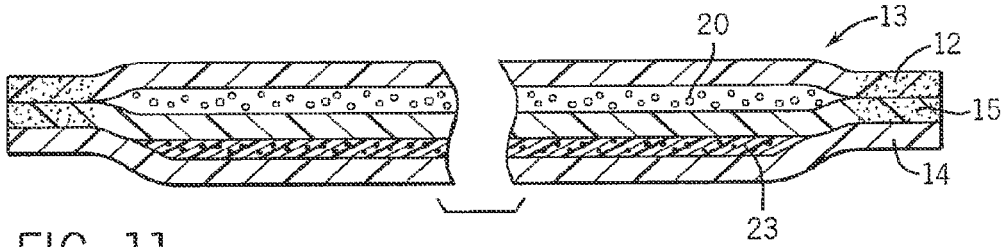

In the FIG. 11 embodiment, the structure is similar to FIG. 8 except that no air gap is left between the detersive mixture 23 and layer 15 as the detersive mix is melt-adhered to both layers 14 and 15.

Figure 12:
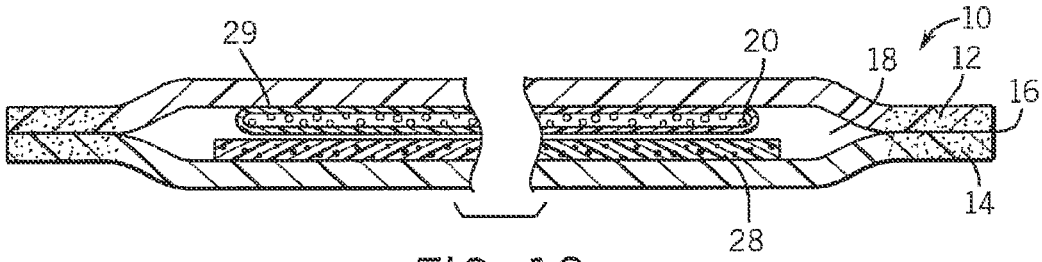
FIG. 12 is a sectional view similar to FIG. 3 showing a third embodiment.

In the FIG. 12 embodiment, the multi-layer surface treatment pad 10 according to the present invention includes a first layer 12 which is slightly abrasive and water-permeable. A second layer 14 is attached to the first layer 12 at the peripheral edges 16. The first and second layers 12 and 14 define a cavity 18 sealed between the first and second layers 12 and 14. In the cavity 18, there is positioned a pouch 29 that contains bleaching agent 20. The pouch 29 may be formed from a water permeable material or a water soluble material as described above. The pouch 29 is preferably attached to the first layer 12. Also in the cavity 18, there is positioned a solid detersive block 28 that may be formed as described above.

Figure 13:
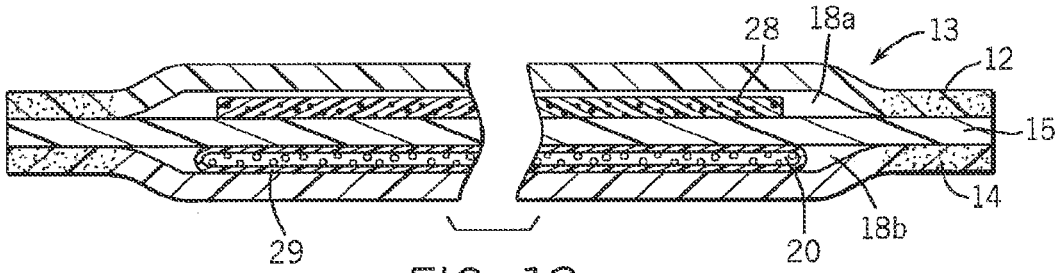
FIG. 13 is a sectional view similar to FIG. 7 showing a fourth embodiment.

In the FIG. 13 embodiment, there are the same outer layers 12 and 14. Layer 12 is water-permeable and optionally (but preferably) abrasive. Third (middle) layer 15 is sandwiched between layers 12 and 14 and is water permeable. The layers 12, 14 and 15 are sealed around the periphery of the layers 12 and 14 and 15 to define a cavity 18*a* between layers 12 and 15 and a cavity 18*b* between layers 14 and 15. In the cavity 18*a*, there is positioned the solid detersive block 28 that may be formed as described above. In the cavity 18*b*, there is positioned the pouch 29 that contains bleaching agent 20.

Figure 14:
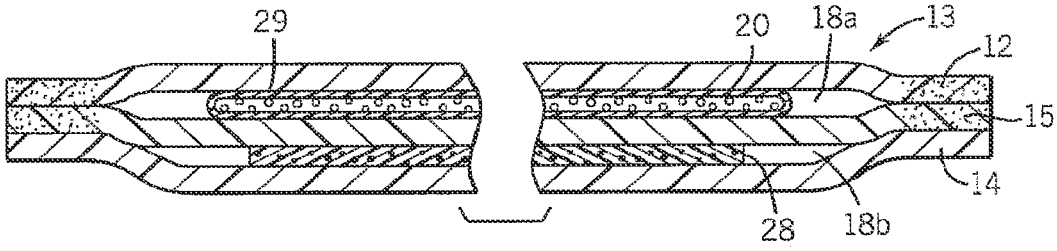
FIG. 14 is a sectional view similar to FIG. 13 showing a fifth embodiment.

In the FIG. 14 embodiment, there are the same outer layers 12 and 14. Layer 12 is water-permeable and optionally (but preferably) abrasive. Third (middle layer) 15 is sandwiched between layers 12 and 14 and is water permeable. The layers 12, 14 and 15 are sealed around the periphery of the layers 12 and 14 and 15 to define a cavity 18*a* between layers 12 and 15 and a cavity 18*b* between layers 14 and 15. In the cavity 18*a*, there is positioned the pouch 29 that contains bleaching agent 20. In the cavity 18*b*, there is positioned the solid detersive block 28 that may be formed as described above.

In the FIG. 15 embodiment, there are the same outer layers 12 and 14. Layer 12 is water-permeable and optionally (but preferably) abrasive. Third (middle layer) 15 is sandwiched between layers 12 and 14 and is water permeable. The layers 12, 14 and 15 are sealed around the periphery of the layers 12 and 14 and 15 to define a cavity 18*a* between layers 12 and 15 and a cavity 18*b* between layers 14 and 15. The detersive mixture 23 is melt-adhered against layer 12 in the cavity 18*a*. In the cavity 18*b*, there is positioned the pouch 29 that contains bleaching agent 20. The pouch 29 is anchored within the cavity 18*b* by including the ends 29*a*, 29*b*, 29*c*, 29*d* of the longer axis of the layers of the pouch 29 into the sealed periphery.

Figure 16:
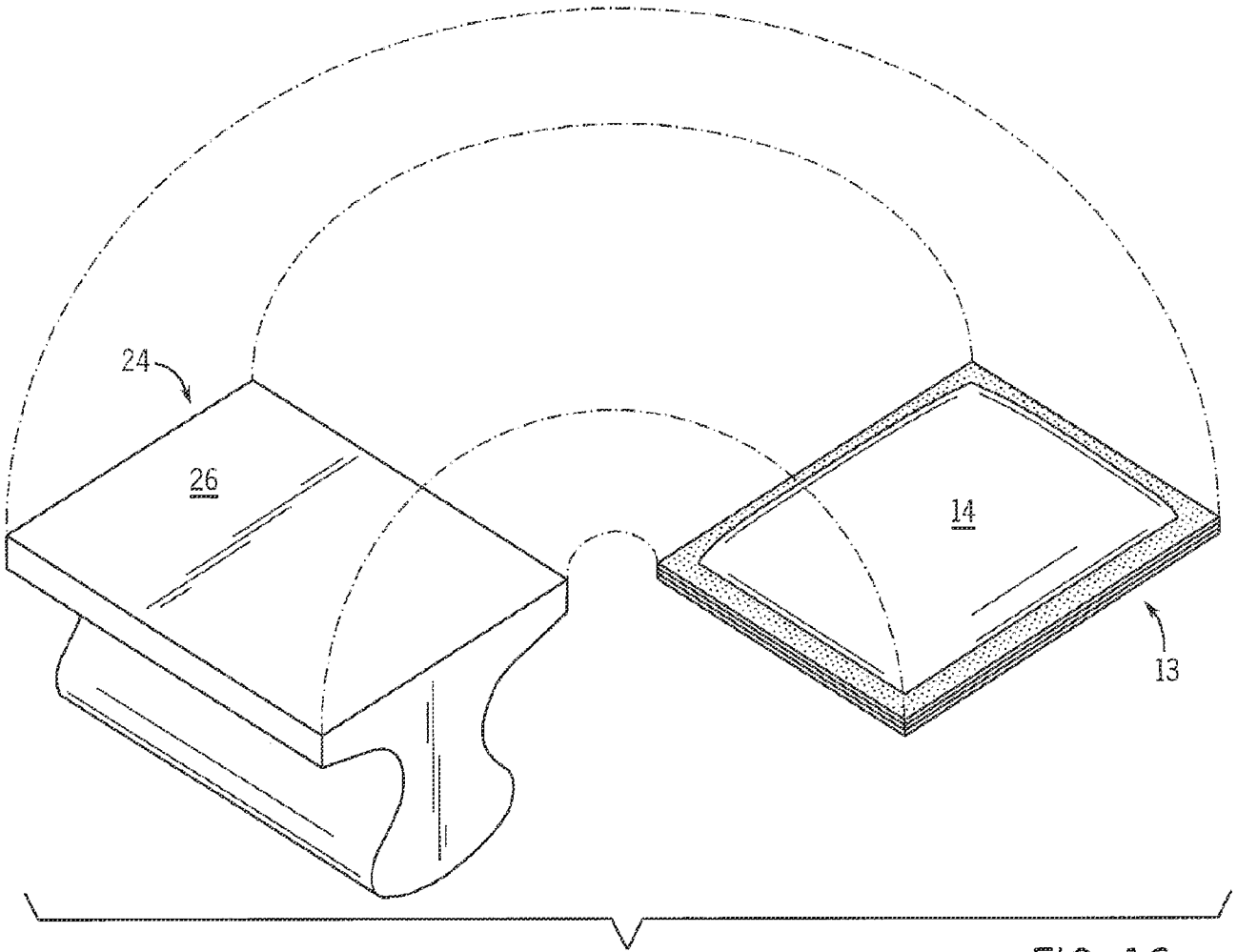
FIG. 16 is a perspective view disclosing how pads of the present invention can be mounted on a mounting handle.
Figure 17:
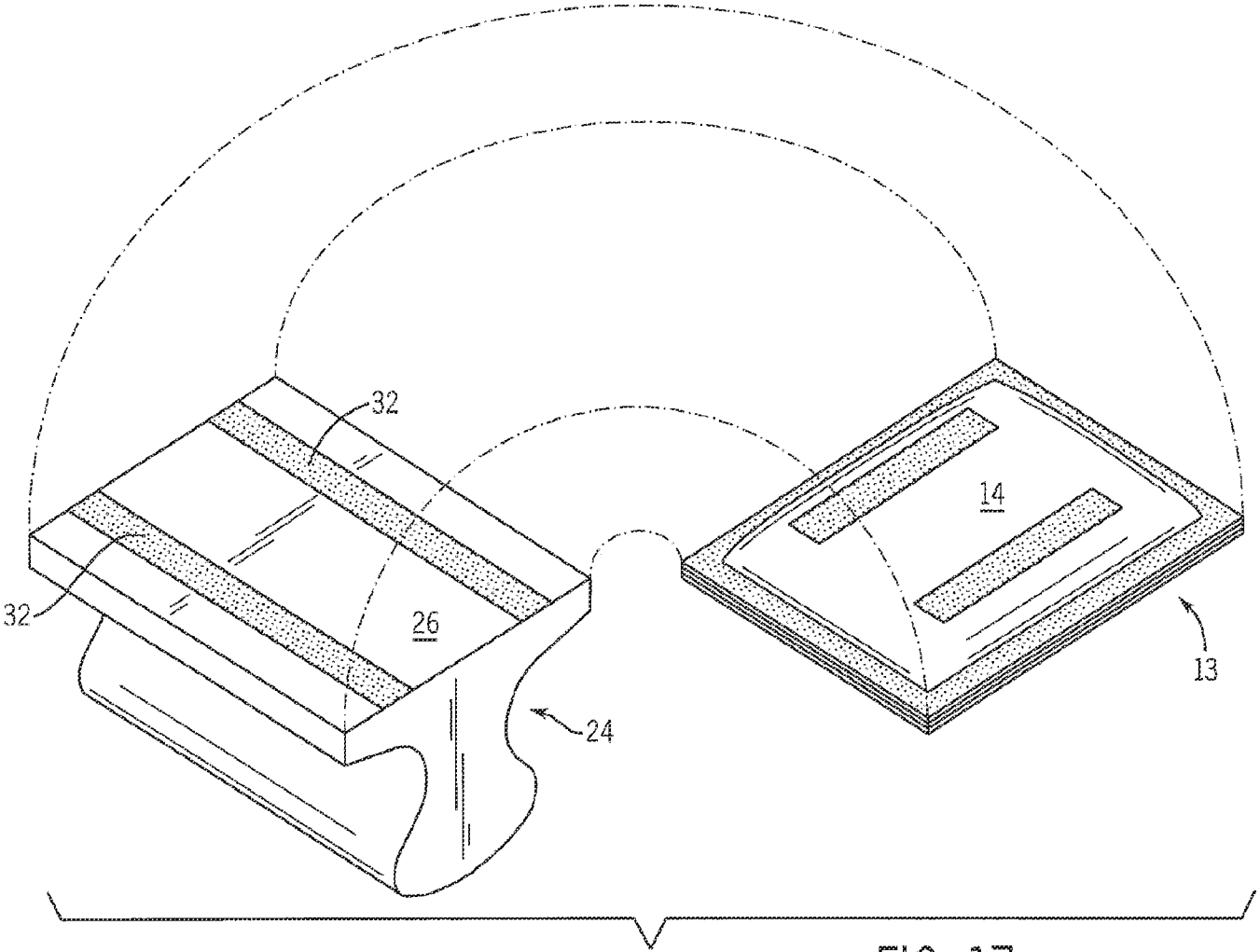
FIG. 17 is a view similar to FIG. 16, but where the handle is modified to facilitate a hook and loop type attachment system when the main handle is made of materials not suitable for that purpose.
Figure 18:
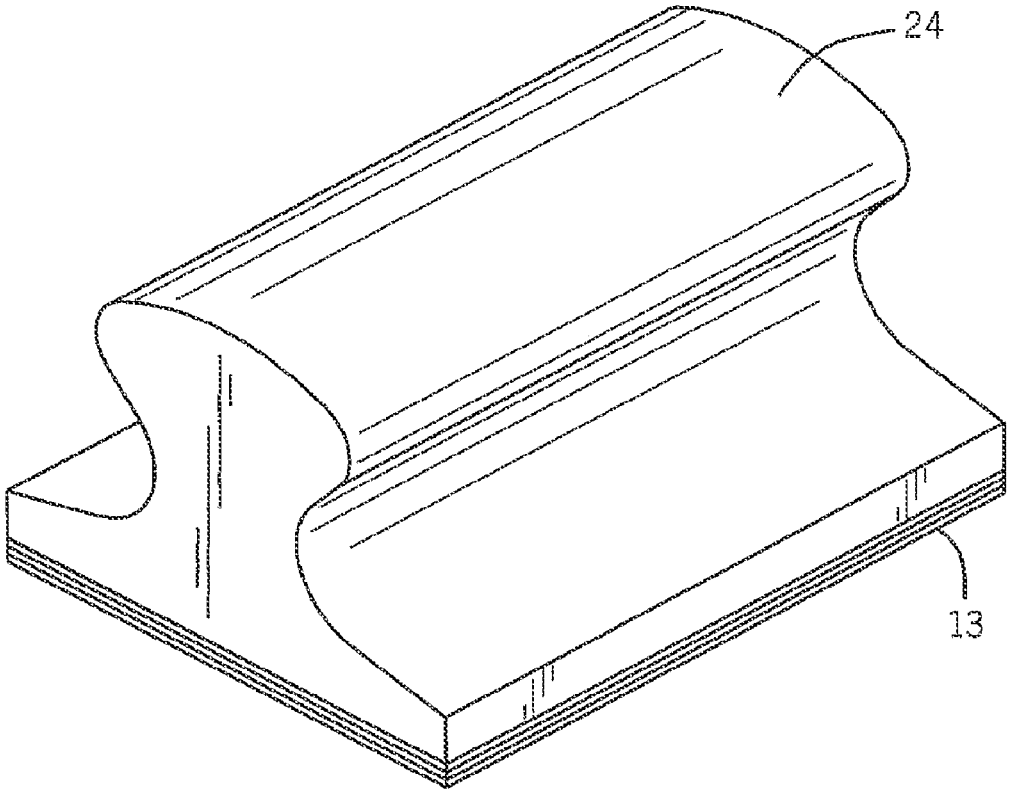
FIG. 18 is a perspective view of a cleaning pad of the present invention mounted on such a mounting handle.

Referring next to FIGS. 16-18, a pad 13 of the present invention can be used in combination with a mounting handle 24. The pad 13 may be attached to the mounting handle 24 by any conventional attachment systems. However, in a preferred aspect, the pad 13 is attached to the mounting handle 24 via hook and loop attachment system.

FIG. 16 is intended to illustrate that the bottom 26 of the handle and the layer 14 can themselves be formed of material which is suitable for a hook and loop attachment system. Alternatively, as shown in FIG. 17, strips 32 of hook or loop type attachment members can be affixed to the bottom 26 of the handle.

As shown in FIG. 18, once the mounting handle 24 has been attached to the pad 13, the pad 13 is ready for use. One preferred technique for using these pads is to wet the pad under running water (for example warm water) for about two seconds. The pad can then be used for scrubbing by contacting a bathroom wall or fixture, or other hard surface.

While one could use the pad by itself, without a handle 24, it is highly preferred to attach such a pad to such a handle as shown in FIG. 18 and as described in more detail in our company's U.S. patent application publication 2006/0048319. One could then hold the handle and use it to direct the pad against the surface being cleaned with greater leverage.

After use the hook-and-loop type attachment system between the bottom of the mounting handle 24 and the first layer 12 of the pad 13 of the present invention could be ripped apart, and the used pad 13 disposed of. A replacement pad 13 could then be abutted against the mounting handle 24 to establish another hook-and-loop connection.

The cleaning pads of the present invention are thus effective for serving a hard surface-cleaning function, and supply their own cleaning chemicals. Particularly important is that they can deliver both bleaching agent and cleaning ingredients to the surface being treated without compromising the chemical integrity of these ingredients, or unduly increasing costs. By isolating the detersive system from the bleaching agent, the stability and chemical integrity of the bleaching agent is optimized. Also, the bleaching agent can, among other things, provide for activity against mold stains, odors and bacteria.

The above description has been that of preferred embodiments of the present invention. It will occur to those that practice the art, however, that still other modifications may be made without departing from the spirit and scope of the invention. For example, the pads may have more than three layers. Alternatively, they need not be square or rectangular in top view. Also, the back layer may have other means of connecting to a handle (e.g. a peel-off layer with adhesive), or other chemicals may be added (e.g. polishes).

Hence, the scope of the invention should not be entirely judged by just the preferred embodiments. Rather, the following claims should be looked to in order to judge the full scope of the invention.

INDUSTRIAL APPLICABILITY

The present invention provides bleaching cleaning pads which can be readily manufactured using conventional equipment and techniques, stored for long periods without compromising the chemical integrity of the cleaning and bleaching ingredients, readily releasing these ingredients upon wetting the pad followed by employing a wiping/scrubbing action on a hard surface by the end-user.

What is claimed is:

1. A multi-layer surface cleaning pad comprising:

a first water permeable outer layer having a periphery;

a second water permeable middle layer having a periphery;

a third outer layer having a periphery, wherein the first, second and third layers are bound to each other around their peripheries creating a multi-layer layer having at least two cavities;

a solid bleaching agent positioned in at least one of the two cavities; and a solid detersive material incorporated into the pad at a position where it is essentially segregated from the solid bleaching agent.

2. The pad of claim 1 wherein:

the solid detersive material is positioned within a cavity formed by the first water permeable layer and the second water permeable middle layer, and the solid bleaching agent is positioned within a second cavity formed by the second water permeable middle layer and the third outer layer.

3. The pad of claim 1 wherein:

the solid bleaching agent is positioned within a cavity formed by the first water permeable layer and the second water permeable middle layer, and the solid detersive material is positioned within a second cavity formed by the second water permeable middle layer and the third outer layer.

4. The pad of claim 1 wherein:

the detersive material is adhered to the first layer, and the solid bleaching agent is positioned within a cavity formed by the second layer and the third layer.

5. The pad of claim 1 wherein the detersive material is melt-anchored to the pad.

6. The pad of claim 1 wherein the third layer is constructed to form a part of a hook and loop attachment system.

7. The pad of claim 1 wherein the solid bleaching agent is contained within a water permeable pouch.

8. The pad of claim 7 wherein:

the pouch has a periphery, and at least a portion of the periphery of the pouch is bound to the periphery of the first layer and/or the periphery of the second layer thereby anchoring the pouch in a location within the cavity.

9. The pad of claim 1 wherein the detersive mixture is a pre-formed solid.

10. The pad of claim 1 wherein:

the solid bleaching agent is a halogen-based bleaching compound selected from the group consisting of trichloroisocyanuric acid, sodium dichloroisocyanurate and sodium dichloroisocyanurate dihydrate, and mixtures thereof.

11. The pad of claim 1 wherein:

the solid bleaching agent is a peroxide-based bleaching compound selected from the group consisting of alkali metal perborate salts, alkali metal percarbonate salts, 2 $KHSO_5$. $KHSO_4.K_2SO_4$, solid organic percarboxylic acid compounds, and mixtures thereof.

12. The pad of claim 1 wherein:

the detersive material comprises a solid water soluble waxy non-ionic surfactant.

13. The pad of claim 12 wherein:

the solid water soluble waxy non-ionic surfactant is flowable at a temperature greater than 40° C.

14. The pad of claim 1 wherein the first layer has an abrasive outer surface.

15. The pad of claim 1 wherein the detersive material is a mixture of (i) at least about 5 wt. % solid nonionic surfactant or polyethylene glycol, and (ii) at least about 10 wt. % solid anionic surfactant.

16. The pad of claim 1 wherein the detersive material is a mixture of (i) about 20 wt. % to about 60 wt. % solid nonionic surfactant or polyethylene glycol, (ii) about 20 wt. % to about 60 wt. % solid anionic surfactant, (iii) about 1 wt. % to about 10 wt. % of a hydrotroping agent, (iv) about 1 wt. % to about 15 wt. % of a detergent builder, and (v) about 1 wt. % to about 20 wt. % of a liquid non-ionic surfactant.

* * * * *